2/16/88 XR 4,725,475

343/911R

United States Patent [19]

Fiscus et al.

[11] Patent Number: 4,725,475

[45] Date of Patent: Feb. 16, 1988

[54] MULTI-OCTAVE THICK DIELECTRIC RADOME WALL

[75] Inventors: Thomas E. Fiscus; Gus P. Tricoles, both of San Diego, Calif.

[73] Assignee: General Dynamics Electronics Division, San Diego, Calif.

[21] Appl. No.: 900,089

[22] Filed: Aug. 25, 1986

[51] Int. Cl.[4] ..... B41J 13/14; B05D 00/00; H01Q 1/42; H01Q 1/36

[52] U.S. Cl. ..... 428/156; 428/141; 428/166; 428/172; 428/309.9; 428/318.4; 428/319.3; 428/319.7; 343/872; 343/873; 343/907; 343/908; 343/911 R

[58] Field of Search ..... 343/705, 872, 873, 878, 343/886, 887, 907, 908, 911 R, 912, 771; 428/116, 117, 118, 141, 156, 158, 159, 166, 170, 172, 304.4, 309.9, 314.2, 318.4, 319.3, 319.7, 35, 36; 244/119, 117 R, 121; 52/80, 791, 792, 785

[56] References Cited

U.S. PATENT DOCUMENTS 2,985,880 5/1961 McMillan ..... 343/907
3,068,956 12/1962 Cooley et al. ..... 181/33
3,197,358 7/1965 Angioletti ..... 428/116
3,523,057 8/1970 Buck ..... 428/156
3,780,374 12/1973 Shibano et al. ..... 343/872

OTHER PUBLICATIONS

Walton, J. D., *Radome Engineering Handbook,* (Marcel Dekker, NY) ©1970, pp. ix, 181, 273, 45–47.

*Primary Examiner*—Norman Morgenstern
*Assistant Examiner*—Margaret A. Burke
*Attorney, Agent, or Firm*—Brown, Martin, Haller & Meador

[57] ABSTRACT

A multi-octave thick dielectric radome wall which includes a dielectric slab having a pair of surfaces and a plurality of pyramidal-shaped dielectric elements mounted on at least one of the surfaces of the dielectric slab. The dielectric constant of the elements is typically greater than the dielectric constant of the slab. In an alternate embodiment, a second dielectric slab is provided adjacent to one of the first dielectric slab surfaces having the elements mounted thereupon with support means for supporting the second dielectric slab in a spaced apart relationship with the first dielectric slab.

19 Claims, 14 Drawing Figures

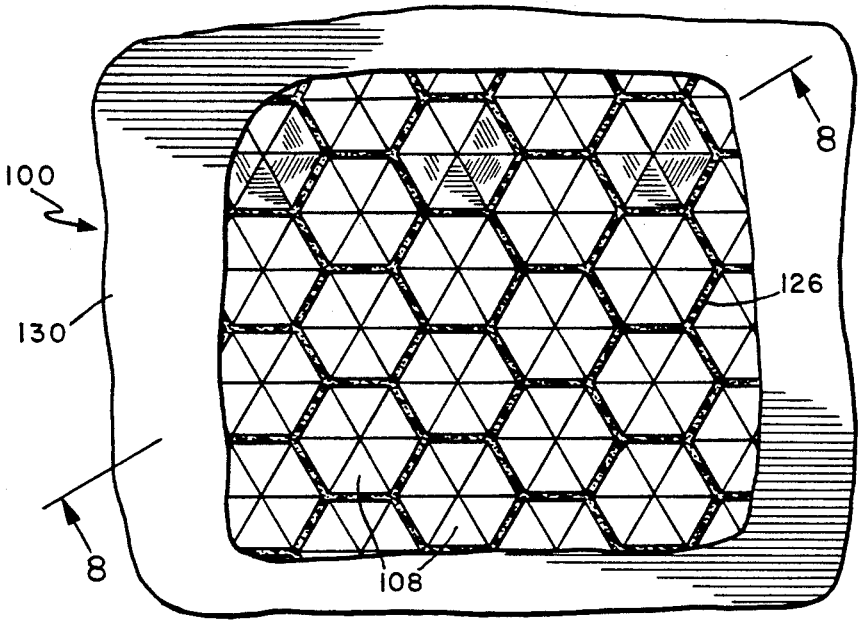
FIG. 7
FIG. 8
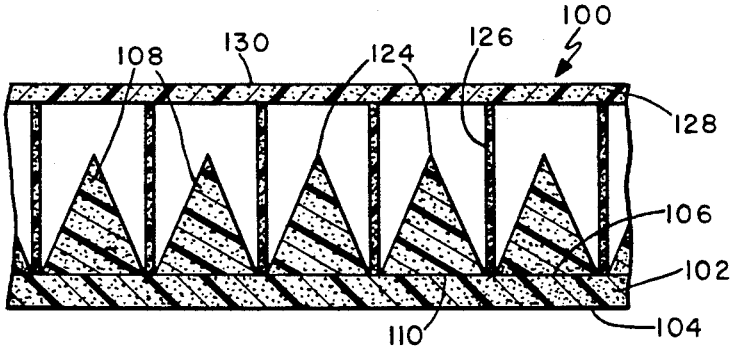
FIG. 9
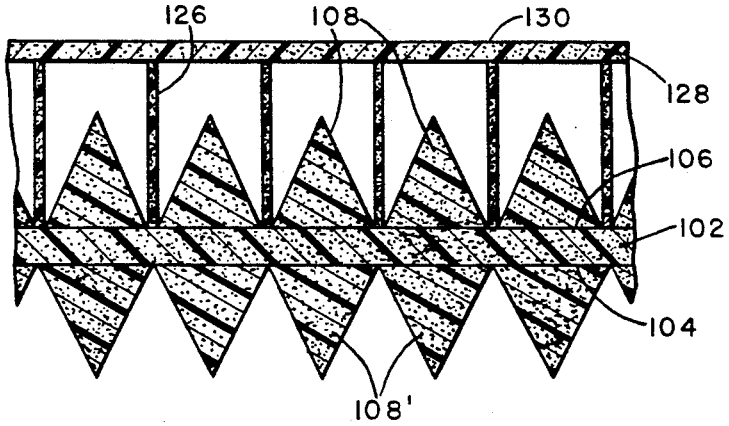

MEASURED FLAT PANEL POWER TRANSMITTANCE $|T|^2$

INCIDENCE ANGLE { • 0° × 30° + 70°

MULTI-OCTAVE THICK DIELECTRIC RADOME WALL

BACKGROUND OF THE INVENTION

I. Technical Field

The present invention relates to radomes. More specifically, the present invention relates to a novel multi-octave thick dielectric radome wall.

II. Background Art

Typical radome wall structures include the homogenous single-layer (monolithic), and multi-layer structures. The monolithic wall structures utilize a single slab of homogeous dielectric material. Within this category of monolithic wall structures is the thin wall structure which has a thickness of less than approximately one-tenth wavelength. Also within this category is the thick wall design where the wall thickness is an interger multiple of one-half wavelength in the dielectric.

With respect to the thin wall design, performance is acceptable at lower frequencies where the permissable electrical thickness provides adequate strength and rigidity. However, at higher frequencies the electrical performance of the thin wall design decreases. In addition, the thin wall design at higher frequencies may not provide adequate strength and rigidity since the wall thickness is a function of the frequency.

With respect to thick wall or resonant wall designs, performance is substantially limited to narrow band applications. In many applications, wide bandwidth requirements may not permit this design due to the inherent narrow band limitations. With a thick wall design, broad bandwidth performance is not achievable since transmittance is reduced at frequencies above and below the wall thickness of one-half wavelength.

Other types of radome wall structures include the multi-layer or sandwich designs. These structures typically consist of three or more layers of differing density dielectric materials. Multi-layer structures provide increased strength rigidity in the radome structure and even permit high transmittance over a broad frequency band. However, with the multi-layer structures uneven performance characteristics in the transmittance exist over the wide frequency band. These uneven performance characteristics may be unacceptable in certain applications.

It is therefore, an object of the present invention to provide a new and improved high strength dielectric radome wall structure of improved electrical performance over a broad bandwidth of frequencies.

It is yet a further object of the present invention to provide a radome wall structure which provides high transmittance over a multi-octave frequency band for high incidence and arbitrary wave polarization.

SUMMARY OF THE INVENTION

The present invention encompasses a multi-octave thick dielectric radome wall which includes a dielectric slab having a pair of surfaces and a plurality of pyramidal-shaped dielectric elements mounted on at least one of the surfaces of the dielectric slab. The dielectric constant of the elements are typically greater than the dielectric constant of the slab. In an alternate embodiment, a second dielectric slab is provided adjacent to one of the first dielectric slab surfaces having the elements mounted thereupon with support means for supporting the second dielectric slab in a spaced apart relationship with the first dielectric slab.

The present invention provides the high mechanical strength through a solid dielectric layer that may be thick with respect to the wavelength in the radome operating band. The present invention also provides high transmittance over a multi-octave frequency band for high incidence and arbitrary wave polarization. Improved transmittance is achieved by the addition of low reflection layers to one or both interfaces of the solid dielectric layer or slab. The low reflection layers are configured as a series of solid pyramidal-shaped dielectric elements positioned adjacent one another on one or both surfaces of the dielectric layer. The pyramidal-shaped elements effectively couple more energy through the radome wall through less reflection at the wall interfaces. The pyramidal-shaped dielectric elements or dielectric apertures reduce slab interface reflections thereby increasing transmittance through the aggregate dielectric body. The transmittance of the radome wall is higher when the series of elements are used on both surfaces of the dielectric layer rather than on a single surface. The dimensions of the dielectric apertures depend upon the operating frequency band of the dielectric body.

BRIEF DESCRIPTION OF THE DRAWINGS

These and other features, object and advantages of the invention, will be more fully apparent from the detailed description set forth below taken in conjunction with the drawings in which like reference characters identify correspondingly throughout and wherein;

FIG. 7 is side elevation view, partially cut away, of an alternate embodiment of a radome wall;

FIG. 8 is a sectional view taken on Line 8—8 of FIG. 7;

FIG. 9 is a sectional view similar to that of FIG. 8 illustrating an alternate embodiment of the radome wall with pyramidal-shaped elements formed on both surfaces of the dielectric slab.

DETAILED DESCRIPTION OF THE PREFERRED EMBODIMENTS

The present invention comprises a novel radome wall structure having the mechanical strength of a thick wall design with the preferred electric characteristics of a thin wall design.

Figure 1:
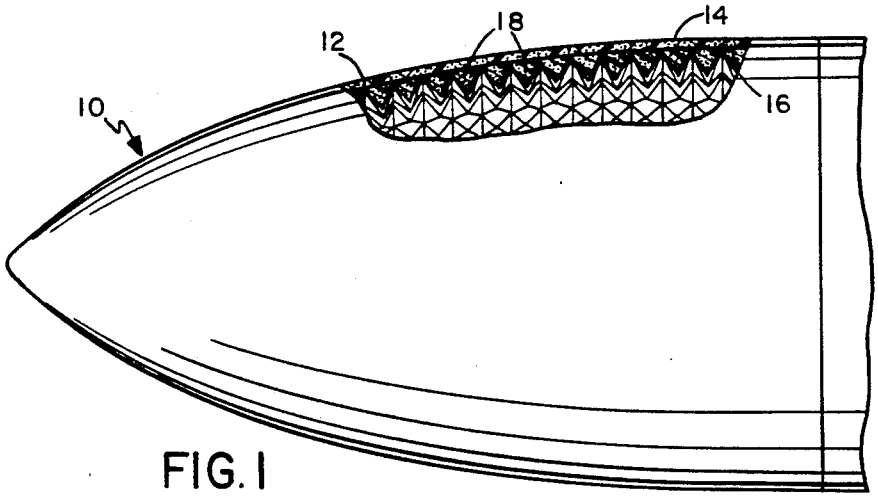
FIG. 1 is a side elevation view of a radome structure partially cut away to illustrate pyramidal-shaped elements mounted on an inner surface of the radome.

Referring to FIG. 1, there is shown an exemplary ogive shaped radome 10 constructed of a dielectric slab or layer 12 with a smooth aerodynamic outer surface 14 and an inner surface 16. A plurality of pyramidal-shaped dielectric elements 18 are formed or mounted upon inner surface 16. Although radome 10 is illustrated in FIG. 1 as being an ogive shape, it may be conical, flat or of varying shapes and sizes depending upon the application. With regard to dielectric slab 12, outer surface 14 and inner surface 16 are substantially parallel with respect to the other.

Figure 2:
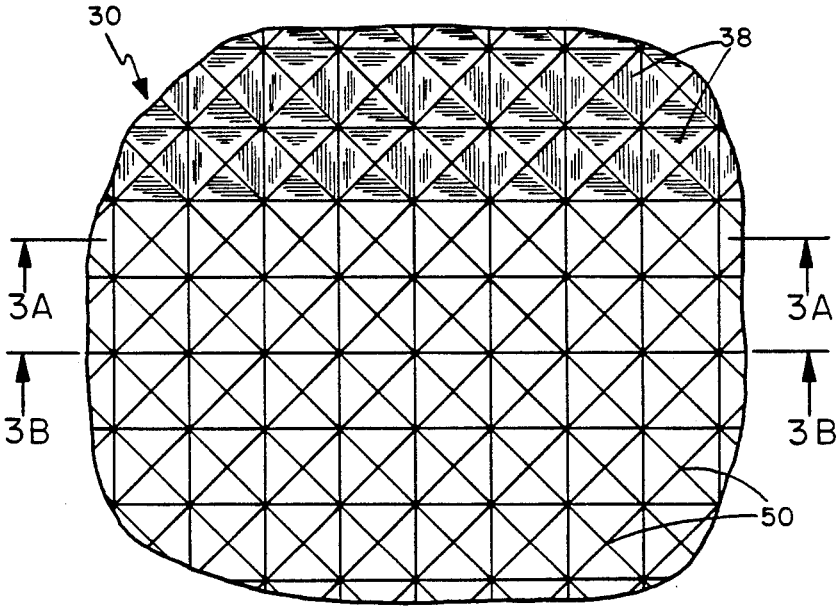
FIG. 2 is a view from inside of a portion of a radome wall illustrating the pyramidal-shaped elements mounted upon a dielectric slab.
Figure 3A:
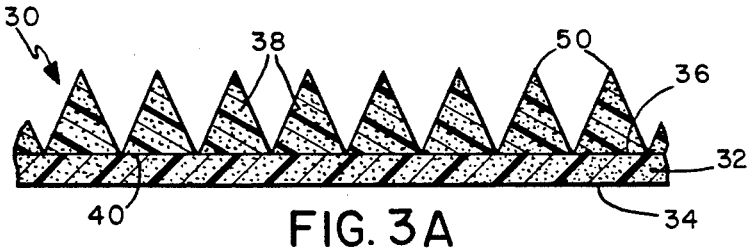
FIG. 3A is a sectional view taken on Line 3A—3A of FIG. 2.
Figure 3B:
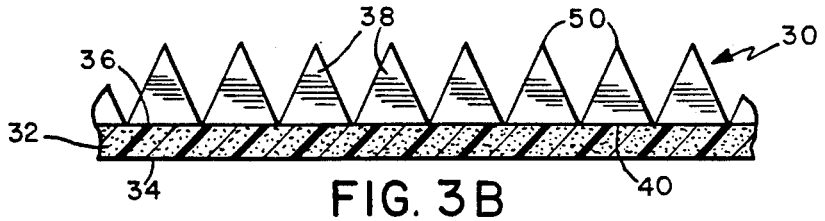
FIG. 3B is a sectional view taken on Line 3B—3B of FIG. 2.

Referring to FIGS. 2 and 3, there is shown a radome wall structure 30 with FIG. 2 illustrating a side view while FIGS. 3A and 3B are sectional views taken respectively across lines 3A—3A and 3B—3B of FIG. 2. Radome wall structure 30 comprises a dielectric slab 32 with substantially parallel surfaces 34 and 36. Mounted upon surface 36 are the plurality of pyramidal-shaped dielectric elements 38. In FIGS. 2 and 3 pyramidal-shaped elements 38 are illustrated as being mounted adjacent one another upon surface 36. In particular, pyramidal-shaped elements 38 each have a base 40 mounted upon surface 36 of slab 32. Pyramidal-shaped elements 38 may be secured to surface 36 by a thin layer of epoxy adhesive (not shown). Pyramidal-shaped elements 38 are illustrated as having a square base 40 such that each element has four sides each triangularly shaped and having a common vertex 50 opposite base 40. Vertex 50 is intersected by an axis extending perpendicular from base 40 and surface 36. Although pyramidal-shaped elements 38 are illustrated herein as having a square base other geometric shapes may be utilized such as a triangular, rectangular, or other polygonal shapes, and even circular or elliptical shaped bases may be implemented. With regard to shapes other than triangular, rectangular, square or other polygonal shapes, the elements are defined as having a base and a surface of rotation being symmetrical about an axis of rotation with respect to an axis extending perpendicular to the base. Included are such shapes as cones, ogive shapes, hemispheres or elliptical variations thereof.

Slab 32 is typically a low loss, low dielectric material having a dielectric constant preferably in the range of 2–10. In certain applications, organic radome materials are selected for environmental conditions and typically have a dielectric constant of about 3. One such material utilized is a polystyrene material sold under the trade name "Rexolite", which has a dielectric constant of 2.53. In other applications, where high temperatures are experienced, such as in applications of high speed airframes, ceramic radome materials may be utilized.

Pyramidal-shaped elements 38 may be constructed of a material having the same dielectric constant as that of the slab 32. However, for a reduction in height of the pyramidal-shaped elements it is preferred that the materials selected for pyramidal-shaped elements 38 have a substantially greater dielectric constant than that of slab 32. It is preferred that the square root of the dielectric constants of the material used in pyramidal elements 38 to that of the material of slab 32, be of a ratio on the order of approximately 10:1.

a comparison of pyramidal-shaped element height for the same and different dielectric constants of the slab and elements is as follows. A polystyrene or "Rexolite" slab having a dielectric constant of 2.53 and a thickness of 0.189 inches is used in this example. The thickness of the slab is one-half wavelength at the highest operating frequency of the radome structure. The same polystyrene or "Rexolite" material with a 2.53 dielectric constant used for the pyramidal-shaped elements would require an element height of 1.89 inches such that the structure is one-half wavelength thick at the lowest operating frequency. However, with the elements formed from a low loss, high dielectric constant material such as titanium dioxide, having a dielectric constant of 100, the element height would only need to be 0.295 inches to achieve the same electrical performance over the frequency band.

The thickness of the radome wall 30 is ultimately determined by the operational frequency bandwidth of the radar system. The thickness of the radome wall, $d_T$, is a summation of the thickness of the slab 32 and the height of pyramidal element 38 as set forth in the following equation:

$$d_T = d_1 + d_2 \tag{1}$$

where:

$d_1$ is the thickness of the dielectric slab and $d_2$ is the thickness or height of the element.

Accordingly, at the highest operating frequency of the system, $F_H$, the thickness of the dielectric slab is determined where:

$$d_1 = \frac{\lambda_H}{2\sqrt{\epsilon_{rs} - \sin^2\theta_s}} \tag{2}$$

where:

$\lambda_H$ is the wavelength at the highest operating frequency, $\epsilon_{rs}$ is the dielectric constant of the slab, and $\theta_s$ is the angle of incidence of the E-field from the slab surface normal.

Substituting the solved slab thickness $d_1$ from equation (2) into the following equation determines the thickness of the overall structure and the height of the element, $d_2$:

$$d_T = d_1 + \frac{\lambda_L}{2\sqrt{\epsilon_{re} - \sin^2\theta_s}} \tag{3}$$

where:

$\lambda_L$ is the wavelength of the lowest operating frequency of the system, $\epsilon_{re}$ is the dielectric constant of the element, and $\theta_s$ is the angle of incidence of the E-field with respect to the slab surface normal.

With respect to the elements, it is preferred that the height-to-base width ratio, $d_2$:W, is preferably of a ratio 3:1 for optimal performance. Although other ratios are permissable, optimal performance has been experimentally achieved at a 3:1 ratio.

Figure 4:
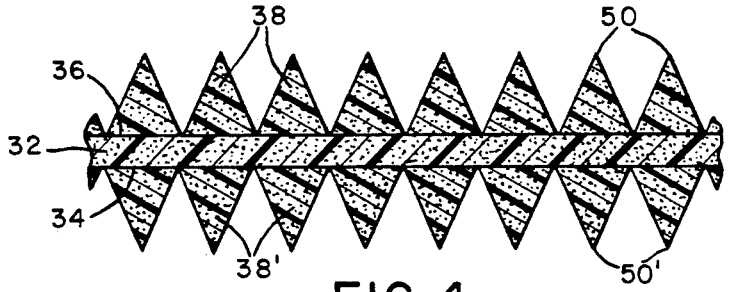
FIG. 4 is a sectional view similar to that of FIG. 3A illustrating an alternate embodiment of the radome wall with pyramidal-shaped elements formed on both surfaces of a dielectric slab.

FIG. 4 is a sectional view similar to that of FIG. 3A and illustrates pyramidal-shaped elements 38 mounted upon slab 32 at surface 36. Mounted correspondingly upon surface 34 are another plurality of pyramidal-shaped elements 38'. Elements 38 and 38' are identical in construction and each pair of corresponding elements 38 and 38' are symmetrically mounted on opposite surfaces of slab 32 and preferably, although not necessarily, share a common axis extending perpendicular to surfaces 34 and 36 which extends through vertexes 50 and 50' and the respective bases. With pyramidal-shaped elements on both sides of the dielectric slab a higher transmittance of the electromagnetic wave through the radome wall structure is realized.

Figure 5:
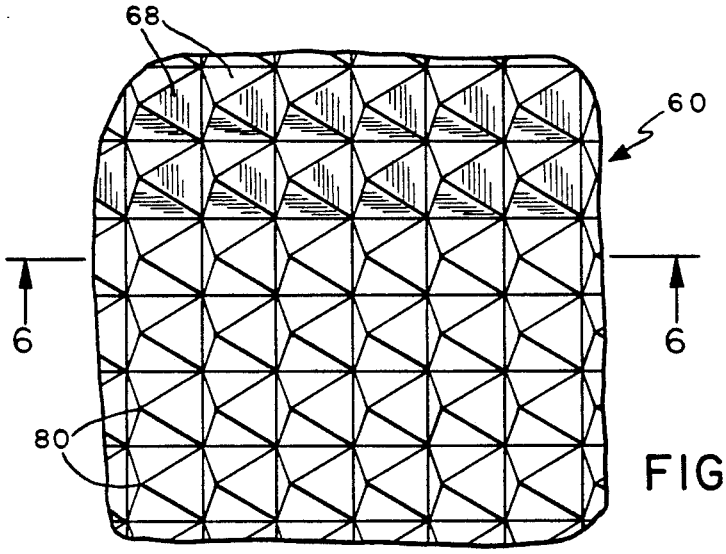
FIG. 5 is an inside view of a portion of a radome wall illustrating tilted pyramidal-shaped elements mounted upon a dielectric slab.
Figure 6:
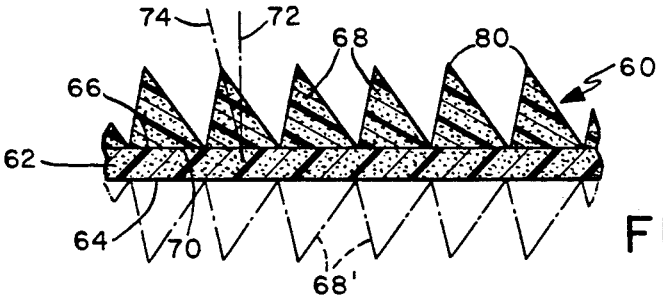
FIG. 6 is a sectional view taken on Line 6—6 of FIG. 5.

FIG. 5 illustrates an alternate embodiment of a radome wall of the present invention. FIG. 6 illustrates the radome wall in a sectional view taken across line 6—6 of FIG. 5. Radome wall 60 is comprised of slab 62 which has substantially parallel surfaces 64 and 66 with a plurality of pyramidal-shaped elements 68 being formed on surface 66. As was illustrated in FIGS. 2-4, elements 68 are illustrated as having a square base 70 and correspondingly four triangularly-shaped sides with a common vertex 80. Elements 68 are tilted in a direction towards the direction of arrival of electromagnetic radiation striking radome wall 60 in a radome structure. Axis 72 is an axis perpendicular to surface 66 and extending through the center of base 70. Axis 74 passes through the center of base 70 and vertex 80. The elements may be tilted at angles in the range of 0-70 degrees between the slab normal axis 72 and axis 74. Correspondingly, elements 68' may be mounted upon surface 64 symmetrically with elements 68 on surface 66 as was described with reference to FIGS. 2-4. Elements 68' are similarly tilted in the same direction as elements 68.

FIGS. 7-9 illustrate an alternate embodiment of the present invention. In FIG. 7, radome wall 100 is illustrated in a top view, partially sectioned with FIG. 8 illustrating a sectional view of radome wall 100 taken across line 8—8. In FIGS. 7 and 8, a dielectric slab 102 is provided and has substantially parallel surfaces 104 and 106. Pyramidal-shaped elements 108 are formed on surface 106. Elements 108 each have a base 110, hexagonal as illustrated in FIG. 7, mounted upon surface 106. Elements 108 have six triangularly-shaped faces sharing a common vertex 124 opposite the base. Vertex 124 is on an axis perpendicular to the base or surface 106 or at a predetermined angle from an axis perpendicular to the base or surface 106. Each pyramidal element 108 is contained within a cell of a honeycomb-type wall structure 126. Wall structure 126 is coupled to surface 106 so as to define a cell having walls which surround each pyramidal-shaped element. Mounted on top of wall structure 126 is a second dielectric slab 128 which is substantially parallel to slab 102. Slab 128 is preferably of the same material as slab 102 so as to have the same dielectric constant as slab 120. Slab 128 has a smooth outer surface 130 to provide an aerodynamic surface.

FIG. 9 illustrates a sectional view of an alternate embodiment of the radome wall of FIG. 7. The radome wall of FIG. 9 has additional pyramidal-shaped elements 108' mounted on surface 104 symmetrical to pyramidal elements 108 mounted on surface 106. The use of elements on opposite surfaces of slab 102 provides increased transmittance of the electromagnetic waves through the radome wall. In certain situations increased transmittance is necessary and an aerodynamically smooth outer surface of the radome wall is required. The addition of elements on both sides of slab 128 provide the increased transmittance while the addition of wall structure 126 and slab 128 provide a supported smooth aerodynamic outer surface for the radome wall. Although pyramidal-shaped elements 108' are illustrated in FIGS. 7-9 as having faces which have a common vertex on an axis perpendicular to the center of a base, the pyramid normal may also be tilted in a direction of the electromagnetic wave propagation as discussed with reference to the radome wall of FIGS. 5 and 6.

Figure 10:
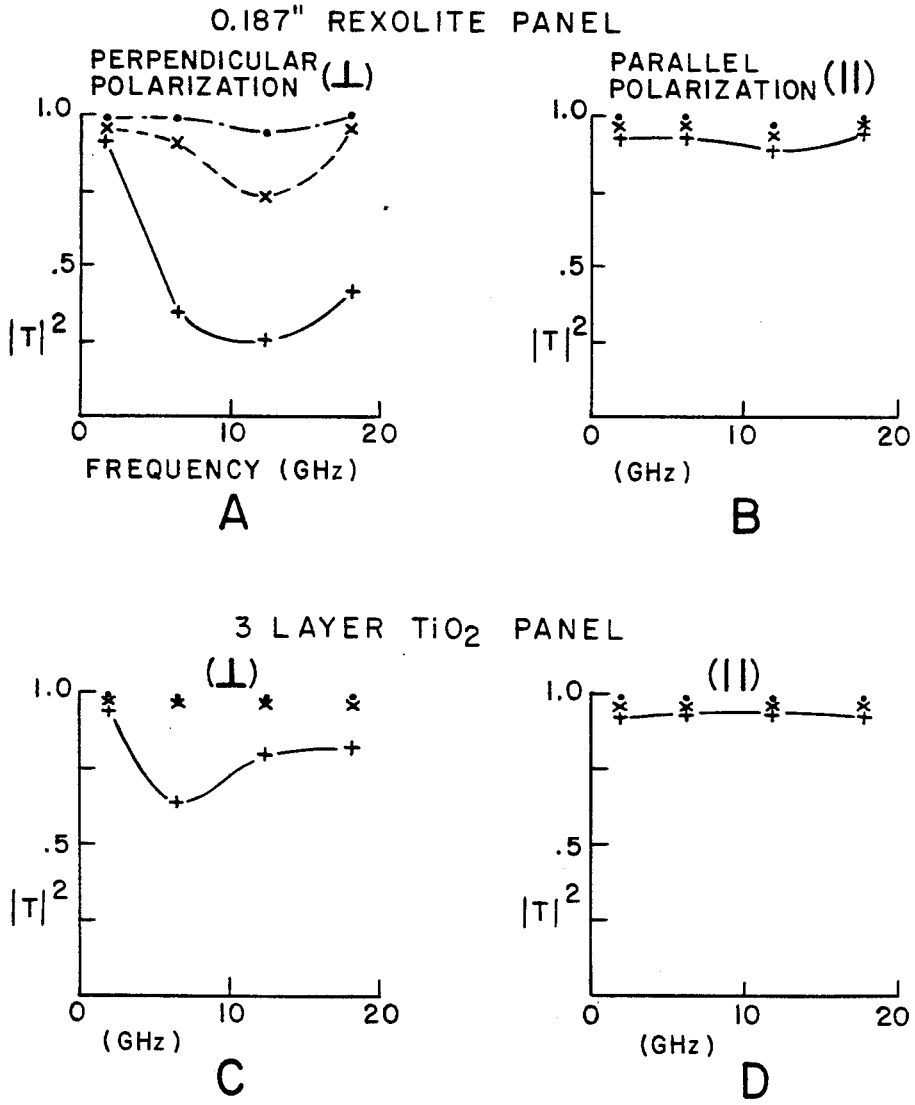
FIGS. 10A–10D show a series of graphs of radome wall electrical performance for a dielectric slab and a dielectric slab with pyramidal-shaped elements mounted thereupon.

FIG. 10 illustrates in graphs A-D experimental data for measured power transmittance $|T^2|$ for a conventional thin wall design radome wall and a design having a slab with pyramidal-shaped elements mounted on both sides of the slab for incidence angles of 0 degrees, 30 degrees and 70 degrees over the frequency range 0-20 GHz for both perpendicular and parallel polarized wavefronts. In FIGS. 10A-10D, experimental data for measured power transmittance $|T^2|$ for 0 degree incident angle is ilustrated by the symbol (.), 30 degree incident angle data is illustrated by the symbol (x) and 70 degree incident angle data is illustrated by the symbol (+).

With reference to graphs 10A and 10B, a flat 0.187 inch thick "Rexolite" or polystyrene panel having a dielectric constant of 2.53 was used for purposes of extracting experimental data. In FIG. 10A the measured power transmittance $|T^2|$ of perpendicular polarized electromagnetic waves for incident angles of 0 degrees, 30 degrees and 70 degrees over the frequency range 0-20 GHz is shown. In FIG. 10B the measured power transmittance $|T^2|$ of parallel polarized electromagnetic waves for incident angles of 0 degrees, 30 degrees and 70 degrees over the frequency range 0-20 GHz is shown.

In FIGS. 10C and 10D, the measured power transmittance $|T^2|$ through a radome wall structure of the present invention is illustrated. A flat 0.187 inch thick "Rexolite" or polystyrene slab having a dielectric constant of 2.53 was utilized. The slab had on both surfaces symmetrically mounted titanium dioxide ($TiO_2$) pyramidal elements each having a three-sixteenth inch square base and a height three-eighth inch. The pyramidal elements each have four identical triangularly-shaped sides with a common vertex. The vertex is located in an axis which extends from the center of the base perpendicularly from the slab surface. In FIG. 10C the measured power transmittance $|T^2|$ of perpendicular polarized electromagnetic waves for incident angles of 0 degrees, 30 degrees and 70 degrees over the frequency range 0-20 GHz is shown. Similarly, in FIG. 10D the measured power transmittance of parallel polarized electromagnetic waves for incidence angles of 0 degrees, 30 degrees and 70 degrees is shown.

A comparison of graphs 10A and 10C indicate that the transmittance for perpendicular polarized electromagnetic waves is greatly enhanced when using the pyramidal element structure of the present invention. At incident angles of 70 degrees a substantially significant improvement in transmittance performance over the frequency band is realized. A corresponding comparison of graphs 10B and 10D also indicates that the transmittance for parallel polarized electromagnetic waves is more constant over the frequency band when using the pyramidal-shaped element structure of the present invention.

The previous description of the preferred embodiments are provided to enable any person skilled in the art to make or use the present invention. Various modification to these embodiments will be readily apparent to those skilled in the art, and the generic principles defined herein may be applied to other embodiments without the use of the inventive faculty. Thus, the present invention is not intended to be limited to the embodiment shown herein, but is to be accorded the widest scope consistent with the principles and novel features disclosed herein.

What is claimed is:

1. A multi-octave thick dielectric radome wall comprising:

a dielectric slab having a pair of surfaces and a predetermined dielectric constant;

a plurality of pyramidal-shaped dielectric elements, each having a predetermined dielectric constant and a base and a surface extending from said base terminated at a common vertex opposite said base, each element base mounted on at least one of said slab surfaces with said elements positioned adjacent one another; and wherein the distance between said slab surfaces and the distance between each element base and respective common vertex is a function of said dielectric constants of said slab and said elements and an operational frequency band of said radome wall.

2. The radome wall of claim 1 wherein the dielectric constants of said slab and said elements are equal.

3. The radome wall of claim 1 wherein the dielectric constant of said elements is greater than the dielectric constant of said slab such that the ratio of the square root of the dielectric constant of said elements to the square root of the dielectric constant of said slab is approximately 10 to 1.

4. The radome wall of claim 1 wherein each pyramidal-shaped dielectric element has a plurality of faces, said faces being triangularly-shaped and sharing said common vertex opposite said base with said common vertex being intersected by an axis extending through said base at a predetermined angle from a second axis extending through the center of said base perpendicular to one of said surfaces.

5. The radome wall of claim 1 wherein each pyramidal-shaped dielectric element has a surface of rotation, said surface of rotation being symmetrical about an axis of rotation with said axis of rotation extending at a predetermined angle from a second axis which is perpendicular to the center of said base.

6. The radome wall of claim 1 further comprising:

a second dielectric slab positioned adjacent to one of said dielectric slab surfaces having said elements mounted thereupon; and support means for supporting said second dielectric slab in spaced apart relationship with said dielectric slab.

7. The radome of claim 6 wherein said support means comprises a honeycomb-type wall structure defining individual cells wherein a respective element is contained.

8. The radome of claim 6 wherein said dielectric slab and said second dielectric slab are substantially parallel.

9. A multi-octave thick dielectric radome wall comprising:

a dielectric slab having a pair of opposed surfaces and a predetermined dielectric constant;

a plurality of pyramidal-shaped dielectric elements, each having a predetermined dielectric constant, each of said elements having a base and a surface extending from said base terminated at a common vertex opposite said base, each element base mounted on at least one of said slab surfaces with said elements positioned adjacent one another;

wherein the dielectric constant of said elements is greater than the dielectric constant of said slab and the distance between said slab surfaces and the distance between each element base and respective common vertex is a function of said dielectric constants of said slab and said elements and an operational frequency band of said radome wall.

10. The radome wall of claim 9 wherein each pyramidal-shaped dielectric element has a base for mounting upon one of said slab surfaces and said element surface has a plurality of faces, said faces being triangularly-shaped and sharing said common vertex opposite said base with said common vertex being intersected by an axis extending through said base at a predetermined angle from a second axis extending through the center of said base perpendicular to one of said surfaces.

11. The radome wall of claim 9 wherein each pyramidal-shaped dielectric element has a base for mounting upon one of said slab surfaces and said element surface is a surface of rotation, said surface of rotation being symmetrical about an axis of rotation with said axis of rotation extending at a predetermined angle from a second axis perpendicular to the center of said base.

12. The radome wall of claim 10 further comprising;

a second dielectric slab positioned adjacent to one of said dielectric slab surfaces having said elements mounted thereupon; and support means for supporting said second dielectric slab in spaced apart relationship with said dielectric slab.

13. The radome wall of claim 12 wherein said support means comprises a honeycomb-type wall structure defining individual cells wherein a respective element is contained.

14. The radome wall of claim 13 wherein said predetermined angle is in the range of 0 to 70 degrees.

15. The radome wall of claim 10 wherein the ratio of the height of an element to the distance across the element base is approximately 3 to 1.

16. The radome wall of claim 11 further comprising:

a second dielectric slab positioned adjacent to one of said dielectric slab surfaces having said elements mounted thereupon; and support means for supporting said second dielectric slab in spaced apart relationship with said dielectric slab.

17. The radome of claim 16 wherein said support means comprises a honeycomb-type wall structure defining individual cells wherein a respective element is contained.

18. The radome wall of claim 17 wherein said predetermined angle is in the range of 0 to 70 degrees.

19. The radome wall of claim 11 wherein the ratio of the height of an element to the distance across the element base is approximately 3 to 1.

* * * * *